US006609392B1

(12) United States Patent
Brown

(10) Patent No.: US 6,609,392 B1
(45) Date of Patent: Aug. 26, 2003

(54) APPARATUS AND METHOD FOR A TEMPERATURE PROTECTED CONTAINER

(75) Inventor: Scott D. Brown, Baldwinsville, NY (US)

(73) Assignee: G. C. Hanford Manufacturing Co., Syracuse, CA (US)

( * ) Notice: Subject to any disclaimer, the term of this patent is extended or adjusted under 35 U.S.C. 154(b) by 0 days.

(21) Appl. No.: 10/105,646

(22) Filed: Mar. 25, 2002

(51) Int. Cl.[7] ..... F25D 3/08

(52) U.S. Cl. ..... 62/457.1; 62/457.2; 220/512; 220/531

(58) Field of Search ..... 62/457.1, 457.2, 62/457.3; 220/507, 510, 512, 529, 531, 739, 742

(56) References Cited

U.S. PATENT DOCUMENTS

| | | | | |
|---|---|---|---|---|
| 4,292,817 A | | 10/1981 | Loucks | |
| 4,425,998 A | | 1/1984 | Hof et al. | |
| 4,589,546 A | * | 5/1986 | Sunderland | 206/315.11 |
| 4,955,957 A | * | 9/1990 | Homes | 220/324 |
| 5,329,787 A | * | 7/1994 | Friday | 62/389 |
| 5,350,081 A | * | 9/1994 | Graham | 220/737 |
| 5,366,089 A | * | 11/1994 | Parker | 206/546 |
| 5,390,797 A | * | 2/1995 | Smalley et al. | 206/542 |
| 5,419,152 A | | 5/1995 | Silber | |
| 5,505,307 A | * | 4/1996 | Shink | 206/541 |
| 5,689,970 A | * | 11/1997 | Chopas | 62/372 |
| 5,816,432 A | * | 10/1998 | Hammen et al. | 220/530 |
| 5,857,778 A | * | 1/1999 | Ells | 383/5 |
| 6,003,719 A | | 12/1999 | Stewart, III | |
| 6,067,813 A | * | 5/2000 | Smith | 62/371 |
| 6,079,404 A | * | 6/2000 | Salyer | 126/263.03 |
| 6,212,901 B1 | * | 4/2001 | Pint et al. | 62/457.7 |
| 6,230,515 B1 | | 5/2001 | Wiesman | |
| 6,243,936 B1 | | 6/2001 | Biesecker et al. | |
| 6,248,690 B1 | * | 6/2001 | McKedy | 502/406 |
| 6,276,162 B1 | * | 8/2001 | Schemel | 62/457.2 |
| 6,336,340 B1 | * | 1/2002 | Laby | 62/371 |
| 6,427,475 B1 | * | 8/2002 | DeFelice et al. | 62/457.2 |
| 6,463,697 B2 | * | 10/2002 | Weder et al. | 47/84 |

FOREIGN PATENT DOCUMENTS

| | | | | |
|---|---|---|---|---|
| JP | 409285331 A | * | 11/1997 | A45C/11/00 |

* cited by examiner

*Primary Examiner*—William E. Tapolcai
*Assistant Examiner*—Mohammad M. Ali
(74) *Attorney, Agent, or Firm*—Bond, Schoeneck & King, PLLC

(57) ABSTRACT

A shipping apparatus includes a container with a closeable top for carrying pharmaceuticals and a cooling means for keeping the pharmaceuticals temperature protected. The apparatus further includes a retention means within the container for positioning and securing the pharmaceuticals and cooling means, and a gripping means for transporting the container.

A method of using a shipping apparatus includes the steps of assembling a container with a closeable top for carrying pharmaceuticals, activating, and inserting a cooling means into a retention means of the container for keeping said pharmaceuticals temperature protected. The steps further include inserting the pharmaceuticals into the retention means within the container for positioning and securing the pharmaceuticals, closing the top of the container and engaging a gripping means for transporting the container.

22 Claims, 3 Drawing Sheets

Fig. 1
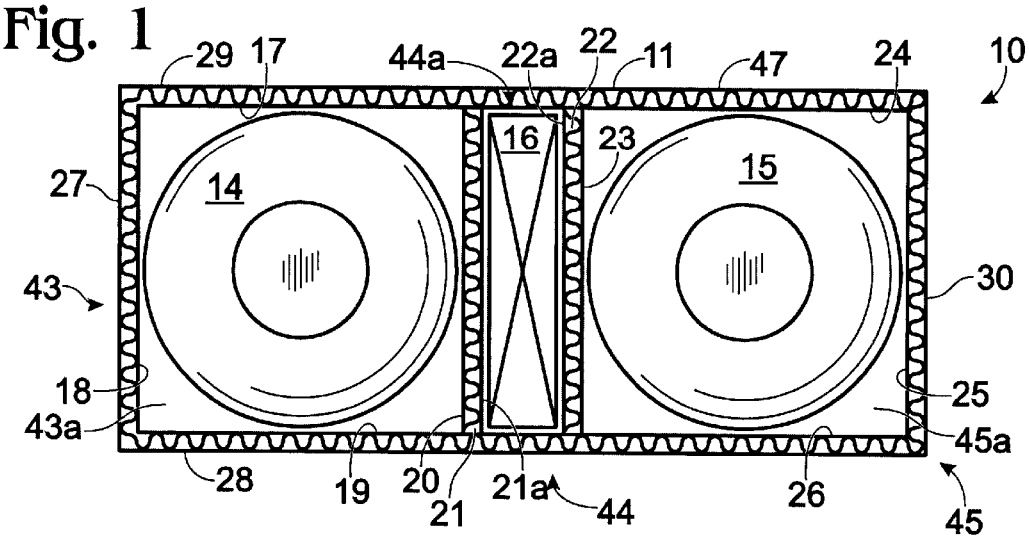
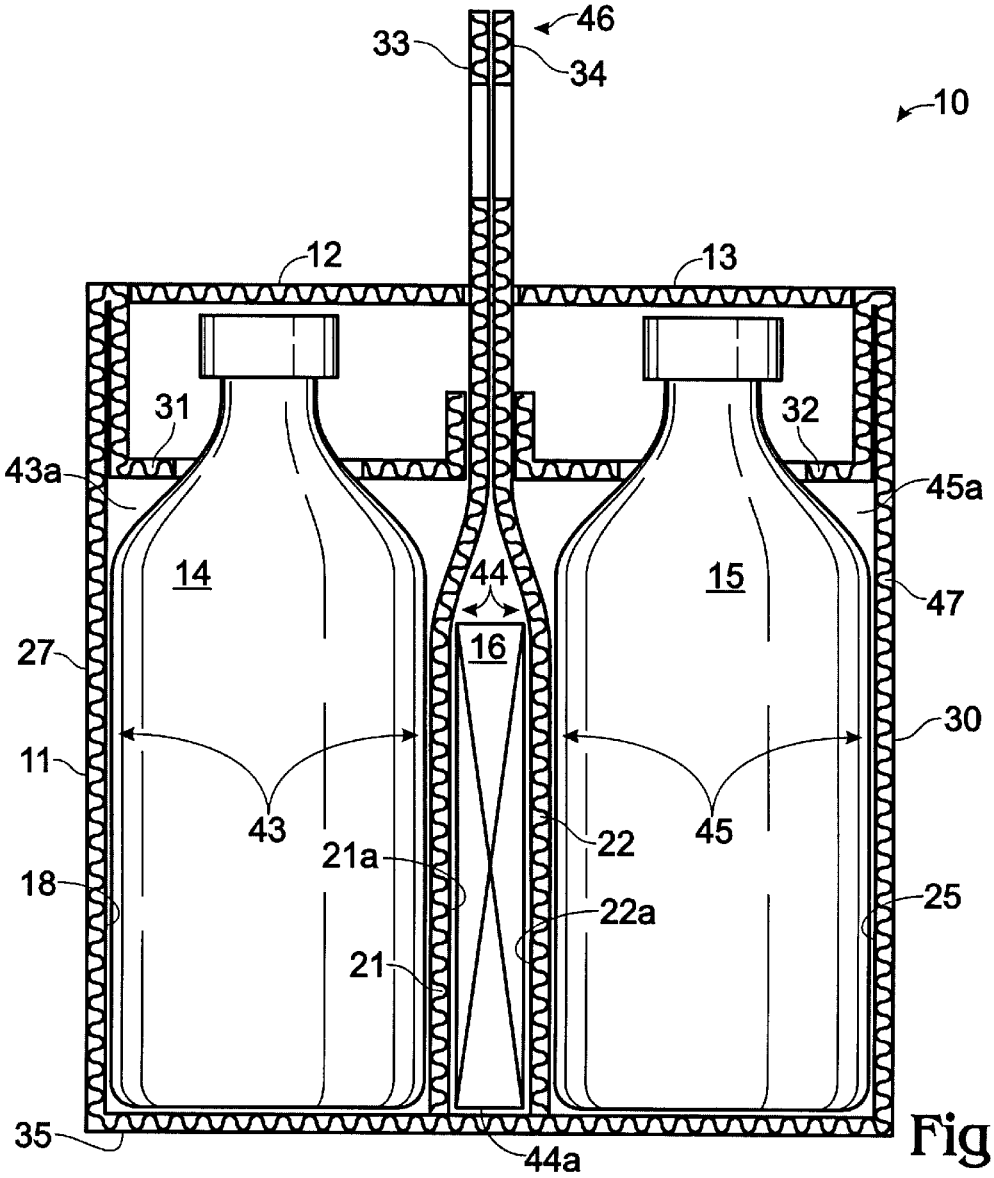
Fig. 2

APPARATUS AND METHOD FOR A TEMPERATURE PROTECTED CONTAINER

FIELD OF THE INVENTION

This present invention relates to a shipping container and, more particularly, to a shipping container whereby pharmaceuticals or the like can be shipped with temperature protection.

BACKGROUND OF THE INVENTION

There exist numerous temperature controlled containers that include various types of refrigeration systems, for example, ice in a portable food storage chest. The need has existed, for some time, to store and ship foods, confections, drugs and the like at lower than ambient temperatures to prevent spoilage or other forms of degradation prior to actual use of the product. It is noted that temperature controlled shipping containers are generally designed for a specific use.

In particular, if drugs or pharmaceutical items are to be shipped it may be critical that a certain predetermined temperature range or level be maintained. On the other hand, if biological degradation is to be slowed in the shipment of, for example, sterile penicillin, another temperature and another type of container must be used. Likewise, standard containers such as Styrofoam chests or other types of refrigeration means, such as ice, have been well known in the prior art and each is adapted to a specific use. However, in the storage and transportation of pharmaceutical substances, serum, vaccines and the like, measures must be taken to insure that the object to be shipped or stored can be constantly kept within a predetermined temperature range. To date this type of storage container is expensive because it is specifically constructed to a particular need.

One such temperature protected container is an assembly that includes a plurality of retention members and a temperature control means. The container includes both an outer protective layer and an inner insulating layer. The outer protective layer and the insulating layer define a shipping cavity containing the liquid retention members and the temperature control means. However, the container is expensive to construct and the cooling means are ice blocks, which must be kept refrigerated prior to use in a waterproof bag or container. The use of ice is both time consuming and irritating, wherein the ice requires an exterior refrigeration system for them to work and does not evenly absorb heat from the object being kept cool. The use of this container with ice packs is not convenient as the ice melts and the remaining liquid must be disposed of prior to using the container again. Finally, this container is difficult to pack and cumbersome to carry.

What is needed is a temperature protected container that is inexpensively constructed, disposable, and carries two off the shelf bottles of penicillin, and the like, that are used on livestock. What is further needed is a temperature-protected container with a cooling means that is simple to use and reusable. Finally, what is also needed is a temperature-protected container that is easy to assemble.

SUMMARY OF THE INVENTION

It is an aspect of this invention to provide a thermally protected container that is inexpensively constructed, disposable, and carries two of the shelf bottles of penicillin, and the like, that are used on livestock.

It is another aspect of this invention to provide a thermally protected container that includes a cooling means that is simple to use and reusable.

It is yet another aspect of this invention to provide a thermally protected container that is easy to assemble.

To accomplish these and other aspects of this invention, a shipping apparatus includes a container with a closeable top for carrying pharmaceuticals and a cooling means for keeping the pharmaceuticals temperature protected. The apparatus further includes a retention means within the container for positioning and securing the pharmaceuticals and cooling means, and a gripping means for transporting the container.

A method of using a shipping apparatus includes the steps of assembling a container with a closeable top for carrying pharmaceuticals, activating, and inserting a cooling means into a retention means of the container for keeping said pharmaceuticals temperature protected. The steps further include inserting the pharmaceuticals into the retention means within the container for positioning and securing the pharmaceuticals, closing the top of the container and engaging a gripping means for transporting the container.

BRIEF DESCRIPTION OF THE DRAWINGS

FIG. 1 is a top section view of the preferred embodiment of the invention.

FIG. 2 is a cross-section view of the preferred embodiment of the invention.

DETAILED DESCRIPTION OF THE INVENTION

Figure 3:
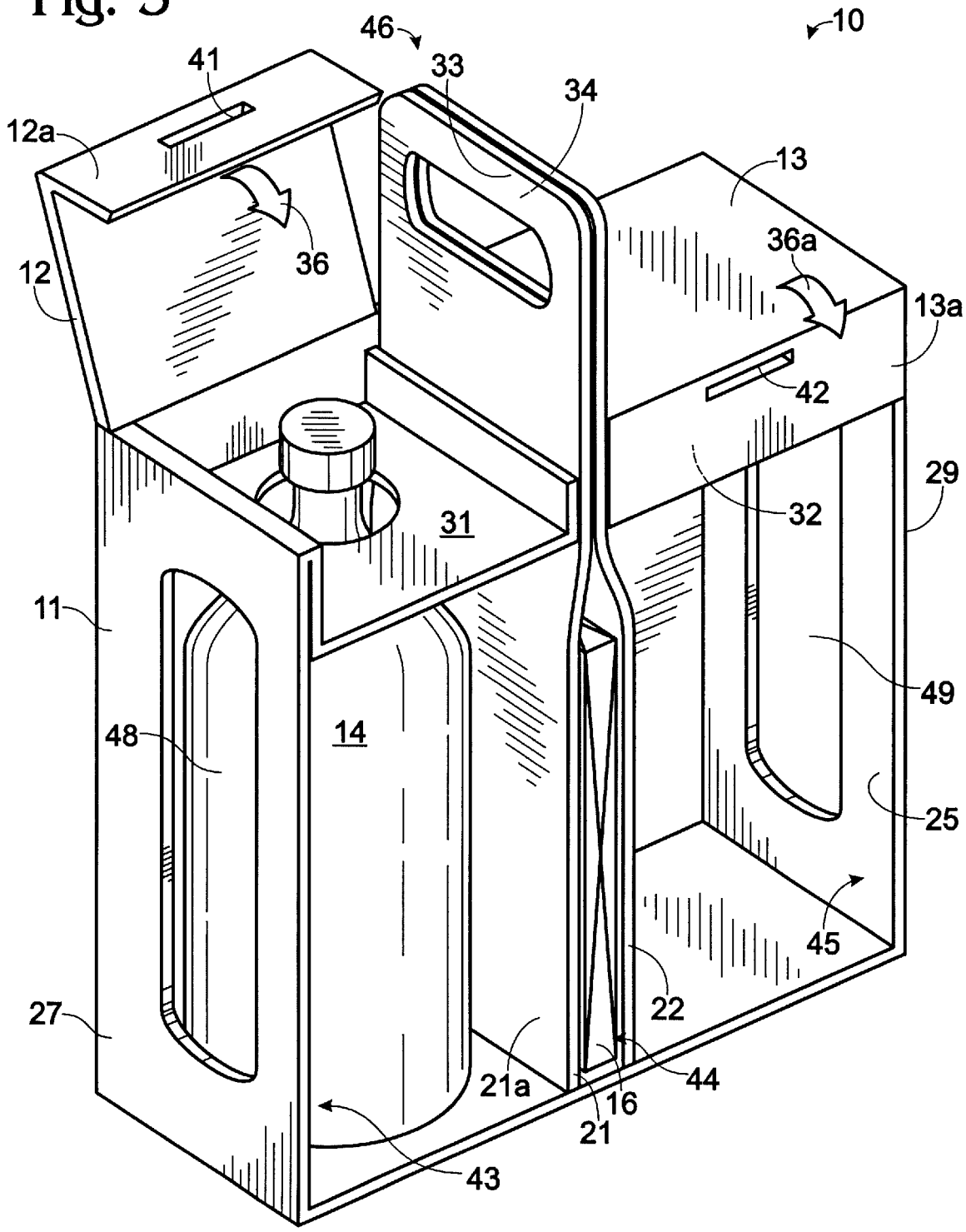
FIG. 3 is a cross-section isometric end view of the preferred embodiment of the invention.

While the present invention is described below with reference to a pharmaceutical shipping container, a practitioner in the art will recognize the principles of the present invention are applicable elsewhere.

FIG. 1 and FIG. 2 shows the apparatus 10 that is the preferred embodiment of the invention. A container 11 has a definable volume that includes a first outer wall 27, a second outer wall 28, a third outer wall 29, a fourth outer wall 30, a bottom 35, a first closeable top 12 and a second closeable top 13. The container is typically, in the preferred embodiment of the invention, rectangular in shape carrying a first pharmaceutical 14 and a second pharmaceutical 15 that are normally an off-the-self-size. The pharmaceutical industry standard for the first pharmaceutical 14 and the second pharmaceutical 15 are bottles of about 500 mL in size. Typically, the container 11 that carries two 500 mL bottles has an overall dimension of about 3.50 inches deep by 6.50 inches high by 7.00 inches long. However, the container 11 rectangular shape is substitutable for a square shape, a circular shape, an oval shape or any polyhedron shape that is desired. The container 11 volume depends on the size of the first pharmaceutical 14 and the size of the second pharmaceutical 15. In another embodiment of the invention the first and second pharmaceuticals are added to and include three and four, or more, pharmaceuticals wherein the container has an increase in volume to carry the additional pharmaceuticals. The larger in size the pharmaceuticals and the larger in number the pharmaceuticals the greater the volume of container 11. Likewise it is comprehensible that container 11 would carry only one pharmaceutical wherein the volume of container 11 would be smaller than the preferred embodiment of the invention.

The first pharmaceutical 14 is positioned into a first retention means 43 that includes a first inner wall 17, a second inner wall 18, a third inner wall 19, a fourth inner wall 20 and bottom 35 whereby forming a first cavity 43*a*. The first pharmaceutical 14 is further retained by a third retention structure 31. The combination of the inner walls, the bottom 35 and third retention structure 31 secures the first pharmaceutical 14, inside the first cavity 43*a*, preventing the first pharmaceutical from spilling. As is understood by the practitioner in the art the first cavity 43*a* varies in size depending on the size of the first pharmaceutical 14 which in the preferred embodiment of the invention is a 500 mL bottle of liquid medicine or the like. The first pharmaceutical 14 is substitutable by other packages, for example, solid chemicals that will also vary in size. This will also vary the size of the first cavity 43*a*.

The second pharmaceutical 15 is positioned into a third retention means 45 that includes a fifth inner wall 23, a sixth inner wall 24, a seventh inner wall 25, an eighth inner wall 26 and bottom 35 whereby forming a third cavity 45*a*. The second pharmaceutical 15 is further retained by a fourth retention structure 32. The combination of the inner walls, the bottom and fourth retention structure 32 secures the second pharmaceutical 15, inside the third cavity 45*a*, preventing the second pharmaceutical from spilling. As is understood by the practitioner in the art, the third cavity 45*a* varies in size depending on the size of the second pharmaceutical 15 which in the preferred embodiment of the invention is a 500 mL bottle of liquid medicine or the like. The second pharmaceutical 15 is substitutable by other packages, for example, solid chemicals that will also vary in size. This will also vary the size of the third cavity 45*a*.

A cooling means 16 is positioned and secured in a second cavity 44*a* by a second retention means 44. The cooling means 16 provides temperature protection to the first and second pharmaceuticals. This serves the dual function of providing direct transfer of cooling energy to the first pharmaceutical 14 and the second pharmaceutical 15 while at the same time making the most economical use of the cooling means 16. The retention means 44 is formed by the bottom 35, a first retention structure 21 with a ninth inner wall 21*a* and a second retention structure 22 with a tenth inner wall 22*a*. The first top 33 of the first retention structure 21 and the second top 34 of the second retention structure 22 form the gripping means 46. As is understood by the practitioner of the art the second cavity 44*a* is a variety of sizes depending on the size of the cooling means 16. The second cavity 44*a* is formed and separated from the first cavity 43*a* by the first retention structure 21 because cold spots my result in the first pharmaceutical 14 without this separation and consequently crystallize and freeze the first pharmaceutical. Likewise, the second retention structure also serves the purpose of eliminating cold spots in the second pharmaceutical 15.

The cooling means 16 is typically a refrigerant gel pak. The gel pak is substitutable for refrigerant foam bricks or gel bottles. The gel paks, gel bottles and foam bricks stay frozen longer than ice due to a slow and even rate of heat absorption. The refrigerant gel paks and foam bricks vary in size, freezing points and gel structures depending on the application. For example, the variety of gel paks include a polymer gel encased in a 5 mil polyethylene pouch, a food safe non-toxic gel encased in a trilaminate foil, gel bottles and a suppressed temperature gel encased in a trilaminate foil. The suppressed temperature gel, for example, has a −10° F. freezing point. Furthermore, the purpose of this type of packaged refrigerant is to prevent contamination and moisture exchange as well as to prevent molten refrigerant from contaminating the goods being thermally shielded.

Another refrigerant that is usable is a foam brick. For example, sodium sulfate decahydrate or calcium chloride hexahydrate is absorbed into a block of open cell phenol-formaldehyde foam and contained in a polyethylene bag closed by heat sealing. Any chemical refrigerant selected should have a melting point about 3 to about 5° C. below the thermo-sensitive temperature of the first pharmaceutical 14 and second pharmaceutical 15. Furthermore, the purpose of this type of packaged refrigerant is to prevent contamination and moisture exchange as well as to prevent molten refrigerant from contaminating the goods being thermally shielded.

The apparatus 10, container 11, in the preferred embodiment of the invention, is constructed as a corrugated box board from fibrous material such as liner board, box board, card board and the like. These materials include, but are not limited to, medium weight box board, heavy weight box board, light weight box board, structured foam, plastic, laminated plastic, and the like. The voids 47 that are formed between the outer and inner walls of container 11, as is readily understood by the practitioner in the art, are typically formed by a corrugated box board construction. Furthermore, the voids 47 that are integral to the construction of corrugated box board are, in the preferred embodiment of the invention are filled with air. However, depending on the application the voids 47 are filled with insulating foam or other insulating materials. Consequently, this enhances the cooling means 16 by slowing the heat absorbed from outside container 11 that would be transferred to the first pharmaceutical 14 and the second pharmaceutical 15. Alternately, if structured foam is used instead of just box board in the container 11, the structured foam is used as an inner insulating layer while and outer layer still consists of the box board, plastic or laminated plastic.

The insulating foam that fills the voids 47 typically comprises a plastic type material. This is to keep container 11 as light weight as possible, yet dramatically enhance the thermal resistance of the walls of container 11. Furthermore, it has been shown that polystyrenes, polyurethanes and other polymeric materials, such as insulating vinyl nitrile, have well known foaming characteristics. It can be stated that the better the thermal insulating properties that the foam material exhibits, the more utility it will have in another embodiment of the present invention.

When structured foam is used it typically comprises a plastic type foaming material with thermal insulating characteristics. This is to keep container 11 as light weight as possible, yet dramatically enhance the thermal resistance of the walls of container 11. Furthermore, it has been shown that polystyrenes, polyurethanes and other polymeric materials, such as insulating vinyl nitrile, have well known foaming characteristics. It can be stated that the better the thermal insulating properties that the foam material exhibits, the more utility it will have in another embodiment of the present invention.

The first outer wall 27, the second outer wall 28, the third outer wall 29, the fourth outer wall 30, the bottom 35, the gripping means 46, the first closeable top 12 and second closeable top 13 are typically constructed out of a box board paper that is coated to protect container 11 from the natural elements such as rain, snow and the like. It is typical to put a waxy type coating on the outside of box board container walls used for shipping to repel any moisture from entering the first cavity 43*a*, the second cavity 44*a* and the third cavity 45*a*. This further enhances the quality of the container 11 and helps maintain the thermal protection of container 11 for the first pharmaceutical 14 and the second pharmaceutical 15.

Now referring to FIG. 3, apparatus 10 shows the first closeable lid 12 in the open position. The first closeable lid is open or closed by a first rotation 36. The second closeable lid 13 is in the closed position. The second closeable lid is open or closed by a second rotation 36*a*. The first closeable lid 12 further comprises a first locking structure 41 that allows the lid to be fixedly secured after the first rotation 36 positions the first closeable lid 12 in the closed position. Alternately, the second closeable lid 13 further comprises a second locking structure 42 that allows the lid to be fixedly secured after the second rotation 36*a* positions the second closeable lid 13 in the closed position. As is known by the practitioner in the art, the first and second locking structure are typically narrow slits that are cut into the first closeable lid 12 and the second closeable lid 13. The first locking structure 41 is positioned as desired on the first flap 12*a*, of the first closeable lid 12, but typically is positioned toward the top and centered on the first flap 12*a*. The second locking structure 42 is positioned as desired on the second flap 13*a*, of the second closeable lid 13, but typically is positioned toward the top and centered on the second flap 13*a*. However, the slit is substitutable for a snap, a tie-back, a self-adhesive latch, and the like, with the corresponding snap, tie-back, self-adhesive latch, and the like, secured to the second outer wall 28 instead of the fist lip 38 and second lip 39.

A first window 48 is provided in the first outer wall 27. This first window 48 enables the user of container 11 to view the first pharmaceutical 14. The user is able to see what first pharmaceutical 14 is present and how much of the pharmaceutical's content is remaining. Likewise a second window 49 is provided in the third outer wall 29. This second window 49 enables the user of container 11 to view the second pharmaceutical 15. The user is able to see what second pharmaceutical 15 is present and how much of the pharmaceutical's content is remaining. The size of the first window 48 and the second window 49 varies depending on the desired opening of the windows. Typically, the overall dimension of the windows are about 0.75 inches wide by 3.75 inches long in a container 11 that has an overall dimension of about 3.50 inches deep by 6.50 inches high by 7.00 inches long.

Figure 4:
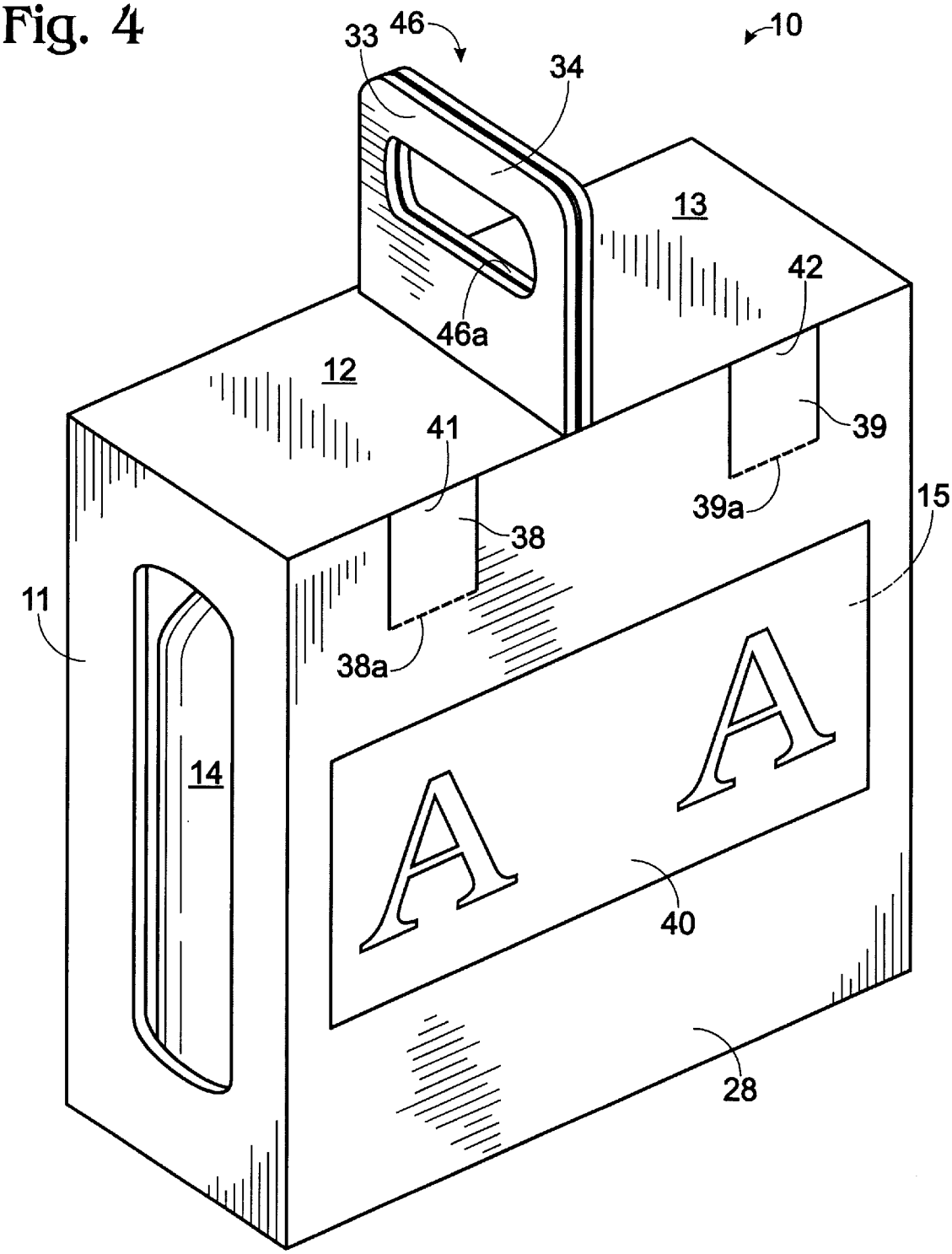
FIG. 4 is an isometric view of the preferred embodiment of the invention.

FIG. 4 shows apparatus 10 with the first pharmaceutical 14 and the second pharmaceutical 15 enclosed in container 11. The first closeable lid 12 is in the closed position. A first lip 38 that is rotatably secured by a first hinge structure 38*a* is inserted into the first locking structure 41. Furthermore, the second closeable lid 13 is in the closed position. A second lip 39 that is rotatably secured by a hinge structure 39*a* is inserted into the second locking structure 42. A design 40 that is a plurality of styles is printed on the second outer wall 28. Furthermore, a design 40 is printed, if desired, on the first outer wall 27, the third outer wall 29 and the fourth outer wall 30. Finally, the gripping means 46 includes a first top 33 of a first retention structure 21 and a second top 34 of a second retention structure 22. The gripping means 46 further includes an opening 46a sized to allow the hand of an individual to grab container 11 and transport container 11 to a desired location.

Experimentation with the preferred embodiment of the invention has shown that the combination of the cooling means 16 using a refrigerated gel-pak positioned in between a first and second pharmaceutical provides adequate temperature protection. The experimentation was preformed using as the contents a sterile penicillin G procaine enclosed in the preferred embodiment of the invention. The present invention has been found to maintain the penicillin at a temperature of about 10% cooler with the refrigerated gel pak than without the refrigerated gel pak after 1 hour exposed to an ambient temperature of about 33.9° C. Also, the present invention maintained temperature of about 5% cooler with the refrigerated gel-pak than without the refrigerated gel-pak after 5 hours exposed to an average ambient temperature of about 34.8° C. Furthermore, the present invention was found to maintain two pharmaceuticals about 48% cooler than one pharmaceutical after 1-hour using a refrigerated gel-pak on both sets exposed to an ambient temperature of 33.2° C.

While there has been illustrated and described what is at present considered to be the preferred embodiment of the invention, it will be appreciated that numerous changes and modifications are likely to occur to those skilled in the art. It is intended in the appended claims to cover all those changes and modifications that fall within the spirit and scope of the present invention.

What is claimed is:

1. A shipping apparatus comprising:

a) a container with a closeable top for carrying pharmaceuticals;

b) a cooling means for keeping said pharmaceuticals temperature protected, said cooling means selected from the group consisting of a refrigerant gel pak, a refrigerant gel bottle and a foam brick, wherein said refrigerant gel pak is selected from the group consisting of a polymer gel encased in a 5 mil polyethylene pouch, a food safe non toxic gel encased in a puncture resistant laminate foil film, a food safe non toxic gel encased in a trilaminate foil and a suppressed temperature gel encased in a trilaminate foil;

c) a retention means within said container for positioning and securing said pharmaceuticals and cooling means; and d) a gripping means for transporting said container.

2. The shipping apparatus as claimed in claim 1, wherein said container is constructed from a plurality of materials.

3. The shipping apparatus as claimed in claim 1, wherein said container is defined by a plurality of shapes.

4. The shipping apparatus as claimed in claim 1, wherein the surface of said container is printed with a plurality of designs.

5. The shipping apparatus as claimed in claim 1, wherein said retention means further comprises a plurality of retention structures.

6. The shipping apparatus as claimed in claim 1, wherein said closeable top is a plurality in number.

7. The shipping apparatus as claimed in claim 6, wherein said closeable lid further comprises a locking structure and a lip that is rotatably secured by a hinge structure to a second outer wall of said container.

8. The shipping apparatus as claimed in claim 1, wherein said container further comprises walls that are insulated.

9. A method of using a shipping apparatus comprising the steps of:

a) assembling a container with a closeable top for carrying pharmaceuticals;

b) activating and inserting a cooling means into a retention means of said container for keeping said pharmaceuticals temperature protected, said cooling means selected from the group consisting of a refrigerant gel pak, a refrigerant gel bottle and a foam brick, wherein said refrigerant gel pak is selected from the group consisting of a polymer gel encased in a 5 mil polyethylene pouch, a food safe non toxic gel encased in a puncture resistant laminate foil film, a food safe non toxic gel encased in a trilaminate foil and a suppressed temperature gel encased in a trilaminate foil;

c) inserting said pharmaceuticals into said retention means within said container for positioning and securing said pharmaceuticals; and d) closing said top and engaging a gripping means for transporting said container.

10. The method of using a shipping apparatus as claimed in claim 9, wherein said container is constructed from a plurality of materials.

11. The method of using a shipping apparatus as claimed in claim 9, wherein said container is defined by a plurality of shapes.

12. The method of using a shipping apparatus as claimed in claim 9, wherein the surface of said container is printed with a plurality of designs.

13. The method of using a shipping apparatus as claimed in claim 9, wherein said retention means further comprises a plurality of retention structures.

14. The method of using a shipping apparatus as claimed in claim 9, wherein said closeable top is a plurality in number.

15. The method of using a shipping apparatus as claimed in claim 14, wherein said closeable lid further comprises a locking structure and a lip that is rotatably secured by a hinge structure to a second outer wall of said container.

16. The method of using a shipping apparatus as claimed in claim 9, wherein said container further comprises walls that are insulated.

17. A shipping apparatus comprising:

a) a container with plural closeable tops for carrying pharmaceuticals;

b) a cooling means for keeping said pharmaceuticals temperature protected;

c) a plurality of retention means within said container for positioning and securing said pharmaceuticals and for positioning and securing said cooling means, wherein said retention means for positioning and securing said cooling means separates and defines a plurality of retention structures that contain the retention means for positioning and securing said pharmaceuticals, wherein each closeable top provides access to only one of said retention structures; and d) a gripping means for transporting said container.

18. The shipping apparatus as claimed in claim 17, wherein said container is constructed from a plurality of materials.

19. The shipping apparatus as claimed in claim 18, wherein said refrigerant gel pak is selected from the group consisting of a polymer gel encased in a 5 mil polyethylene pouch, a food safe non toxic gel encased in a puncture resistant laminate foil film, a food safe non toxic gel encased in a trilaminate foil and a suppressed temperature gel encased in a trilaminate foil.

20. The shipping apparatus as claimed in claim 17, wherein said container further comprises walls that are insulated.

21. The shipping apparatus as claimed in claim 17, wherein each of said plural closeable tops further comprises a locking structure and a lip that is rotatably secured by a hinge structure to a second outer wall of said container.

22. The shipping apparatus as claimed in claim 17, wherein said cooling means is selected from the group consisting of a refrigerant gel pak, a refrigerant gel bottle and a foam brick.

* * * * *